US006481588B1

(12) United States Patent
Wagner

(10) Patent No.: US 6,481,588 B1
(45) Date of Patent: Nov. 19, 2002

(54) CLOSURE CAP FOR CONTAINER WITH FIXING FLANGE

(75) Inventor: Armand Wagner, Esch/Alzette (LU)

(73) Assignee: L & M Services B.V. (NL)

( * ) Notice: Subject to any disclaimer, the term of this patent is extended or adjusted under 35 U.S.C. 154(b) by 0 days.

(21) Appl. No.: 09/857,400

(22) PCT Filed: Dec. 4, 1998

(86) PCT No.: PCT/IB98/02012

§ 371 (c)(1),
(2), (4) Date: Aug. 13, 2001

(87) PCT Pub. No.: WO00/34142

PCT Pub. Date: Jun. 15, 2000

(51) Int. Cl.[7] ..... B65D 39/00
(52) U.S. Cl. ..... 215/235; 220/831
(58) Field of Search ..... 215/235, 236–239, 215/241, 242, 245, 254–256; 220/831, 832, 847, 837, 820, 816

(56) References Cited

U.S. PATENT DOCUMENTS 3,272,368 A * 9/1966 Baarn ..... 215/41
3,441,161 A * 4/1969 Baarn ..... 215/40
4,625,898 A * 12/1986 Hazard ..... 222/517
4,919,286 A * 4/1990 Agbay, Sr. ..... 215/235
5,065,911 A * 11/1991 Rohr et al. ..... 222/517
5,088,612 A * 2/1992 Storar et al. ..... 215/247
5,271,536 A * 12/1993 Wilson ..... 222/498
5,395,015 A * 3/1995 Bolen, Jr. et al. ..... 222/546
5,605,240 A * 2/1997 Guglielmini ..... 215/256

* cited by examiner

*Primary Examiner*—Lee Young
*Assistant Examiner*—Lien Ngo
(74) *Attorney, Agent, or Firm*—Fletcher, Yoder & Van Someren

(57) ABSTRACT

The invention provides a cap for hermetically closing a receptacle having a retention flange, the cap being constituted by a lid surmounting a lateral skirt which is provided, in a bottom portion, with means for snap-fastening beneath said flange and in a top portion, with a removable tamper-proofing strip occupying a fraction of the periphery of the skirt where it provides a temporary connection with said lid, and also providing a hinge in its complementary fraction; the cap being characterized in that said lid carries a locking tab whose free end is provided with a retractable catch suitable for coming into abutment against the flange of the receptacle in the fully-open position.

18 Claims, 3 Drawing Sheets

CLOSURE CAP FOR CONTAINER WITH FIXING FLANGE

The present invention relates to a cap for hermetically closing a receptacle having a retention flange.

Traditional caps are made by molding and generally comprise a lid surmounting a lateral skirt which is provided, in a bottom portion, with means for snap-fastening beneath said flange, and in a top portion, with a removable tamperproofing strip occupying a fraction of the periphery of the skirt where it provides a temporary connection with the lid, and also providing a hinge in its complementary fraction.

However, with such caps, the lid does not remain in its fully-open position.

The plastics material used, in particular for making the hinge, possesses shape memory which has a tendency to return the lid towards the position it originally had on leaving the mold, which corresponds to the lid being closed.

Thus, after the tamperproofing strip has been removed, the equilibrium position of the lid corresponds to a partially-open position, which interferes with dispensing the content.

An object of the present invention is to resolve this technical problem in satisfactory manner.

According to the invention, this object is achieved by means of a cap characterized in that said lid carries a locking tab whose free end is provided with a retractable catch suitable for coming into abutment against the flange of the receptacle in the fully-open position.

According to an advantageous characteristic, said hinge comprises two bridges leaving a slot between them into which said locking tab extends.

Preferably, each of the bridges has a cavity defining a preferred zone for elastic deformation to enable the lid to be pivoted.

In a specific variant, said cavity is bordered laterally by two reinforcing ribs.

According to another characteristic, said catch is situated below the level of said cavity in the closed position of the lid.

According to yet another characteristic, said catch extends radially outwards in the closed position of the lid.

According to another variant, said catch has a chamfered outside side face for guiding the tab in contact with said flange.

According to a particular characteristic, said catch has a hook-forming trapezoidal cross-section.

Preferably, said locking tab is provided with a stiffener element bearing against its inner face to prevent it from bending inwards.

According to yet another variant, one of the ends of the tamperproofing strip is provided with a tongue.

Preferably, said tongue is received in a corresponding cutout of the lateral skirt.

In particular variants, said means for snap-fastening the skirt beneath the flange are constituted by a partially peripheral internal bead, while the bottom edge of said skirt comes into abutment against a bottom shoulder on the neck of the receptacle.

Furthermore, provision is made for said lateral skirt to be connected to the lid vertically in register with its peripheral edge in such a manner as to define a cylindrical envelope prior to snap-fastening on the receptacle.

Furthermore, the cap can further comprise a cylindrical sleeve secured to the bottom face of said lid and designed to be inserted inside the receptacle to come into leakproof contact with its top inside wall.

Advantageously, the peripheral edge of the lid is provided with a cutout in its zone diametrically opposite from the hinge.

The cap of the invention provides a stable fully-open position making it easy to dispense the content under all circumstances. Furthermore, the lid can be passed from the closed position to the fully-open position without any significant effort.

Finally, the cap of the invention is particularly simple and thus easy to make, making it possible to provide a fully functional assembly at an economic cost price.

The invention will be better understood on reading the following description accompanied by the drawings, in which.

The cap of the invention is designed to close a receptacle in sealed manner, the top portion of the neck of the receptacle being provided with a retention flange. The cap is preferably made by injection molding or compressing an elastically deformable plastics material.

Figure 1:
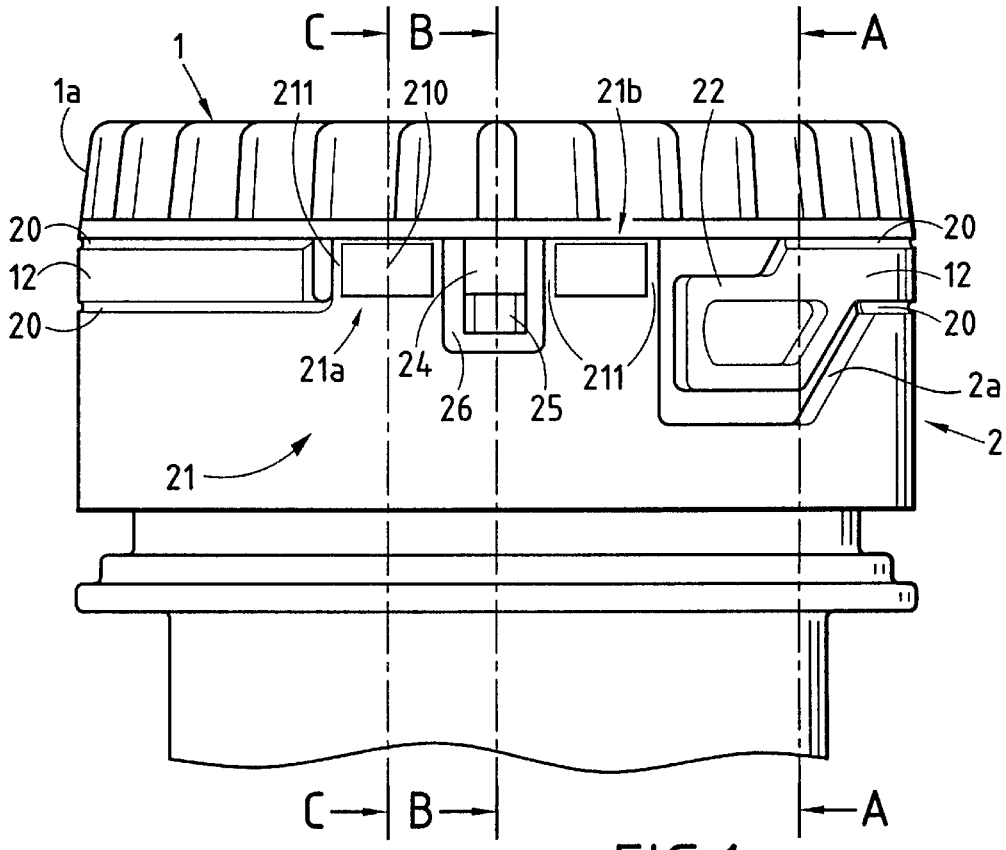
FIG. 1 is a side view of an embodiment of the cap of the invention.
Figure 2:
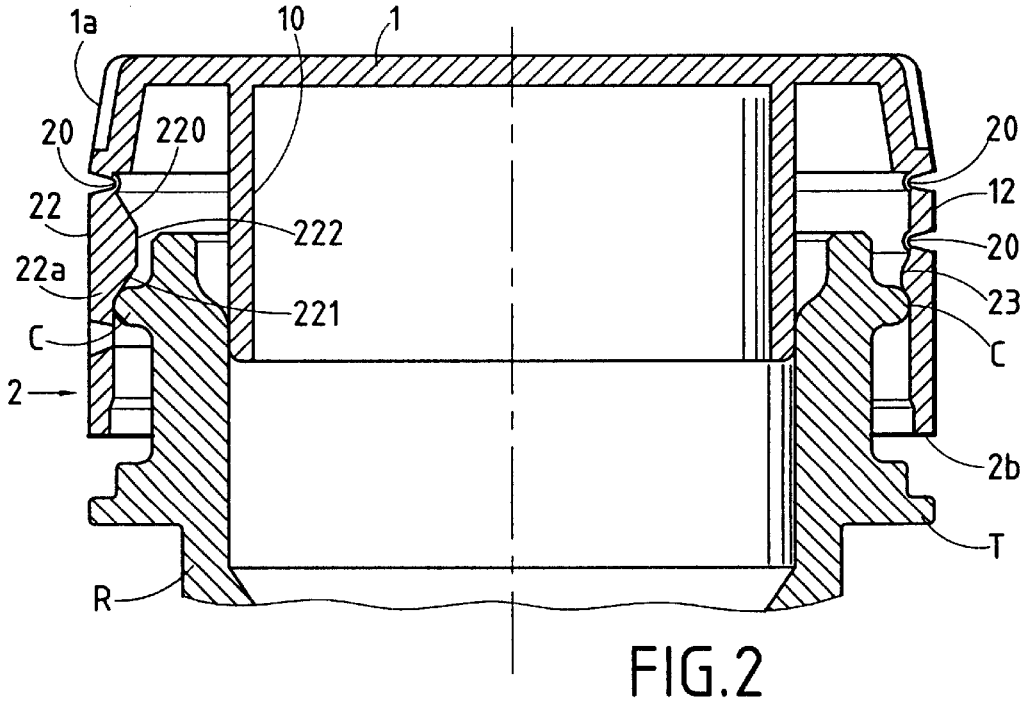
FIG. 2 is a section view on AA of the FIG. 1 cap during assembly on a receptacle.

The embodiment of the cap shown in FIG. 1 comprises a lid 1 surmounting a lateral skirt 2 which is provided in its bottom portion with means for snap-fastening between the flange C of the receptacle R (see FIG. 2). The skirt 2 is also provided in its top portion with a removable tamperproofing strip 12. The skirt 2 is connected to the lid 1 vertically in register with the peripheral edge 1*a* of the lid.

The tamperproofing strip 12 provides a removable and temporary connection between the lid 1 and the skirt 2. The strip 12 is connected to the lid 1 and to the skirt 2 via a fragile peripheral film 20 that is suitable for breaking or tearing.

The tamperproofing strip 12 has a tongue 22 which extends downwards and having at least a portion, in this case its bottom portion, that is free, i.e. that is not held by any film 20.

The tongue 22 is preferably made at one of the ends of the strip 12 and at rest is received in coplanar manner with the skirt 2 and the strip 12 in a corresponding cutout 2*a* so that prior to snap-fastening on the receptacle R a substantially cylindrical envelope is defined.

The strip 12 occupies only a fraction of the periphery of the lateral skirt 2 leaving a complementary fraction that constitutes a hinge 21.

The hinge 21 is made up of two bridges 21*a*, 21*b* leaving between them a slot 26. As can also be seen in FIG. 4, each of the bridges 21*a*, 21*b* has a cavity 210 defining a preferred zone for elastic deformation and/or bending enabling the lid 1 to pivot upwards.

The cavity 210 is bordered on its sides by two reinforcing ribs 211.

The lid 1 carries a locking tab 24 whose free end is provided with a retractable projection or catch 25 suitable for co-operating with the flange C of the receptacle to hold the lid 1 in its fully-open position.

The locking tab 24 is received in the slot 26 and the catch 25 extends radially outwards when the lid 1 is closed.

FIG. 2 is a section view through the embodiment of FIG. 1 at the beginning of being installed on the receptacle R. In this figure, it can be seen that the cap also has a cylindrical sleeve 10 secured to the bottom face of the lid 1. This sleeve 10 is for insertion into the inside of the top portion or neck of the receptacle R in leakproof contact with its inside wall (see FIGS. 3 and 4).

During this stage of installation, the snap-fastening means of the skirt 2 have not yet locked under the flange C of the receptacle R. These means are constituted by a partially peripheral internal bead 23 which, in this position, rests on the flange C.

The tamperproofing strip 12 and its tongue 22 are connected to the bottom face of the lid 1 at a distance from its peripheral edge 1*a* corresponding substantially to the thickness of their projecting outside portions so as to obtain an envelope that is substantially cylindrical.

In order to improve the continuous and cylindrical appearance of the cap, the outside face of the tongue 22 is made in this case in the form of a portion of a cylinder, and where appropriate it includes and internal cavity. The bottom and top edges of the strip 12 and of the tongue 22 are preferably chamfered.

The inside face of the tongue 22 of the tamperproofing strip 12 is provided with a projection 22*a*.

The projection 22*a* is situated on the skirt 2 at substantially the same height as the internal bead 23 such that in the position shown in FIG. 2 it, like the bead, rests on the flange C. The profile of the projection 22*a* has at least two, and preferably three, plane facets.

The top facet 220 and the bottom facet 221 slope at an angle lying in the range 20° to 40° relative to the vertical axis of the projection. The central facet 222 is parallel to said axis. The top facet 220 slopes so as to make the cap easier to eject from the mold during manufacture.

The stage during which the internal bead 22 is snap-fastened begins by applying the bottom facet 221 against the flange C, with said sloping facet then sliding over the flange.

Figure 3:
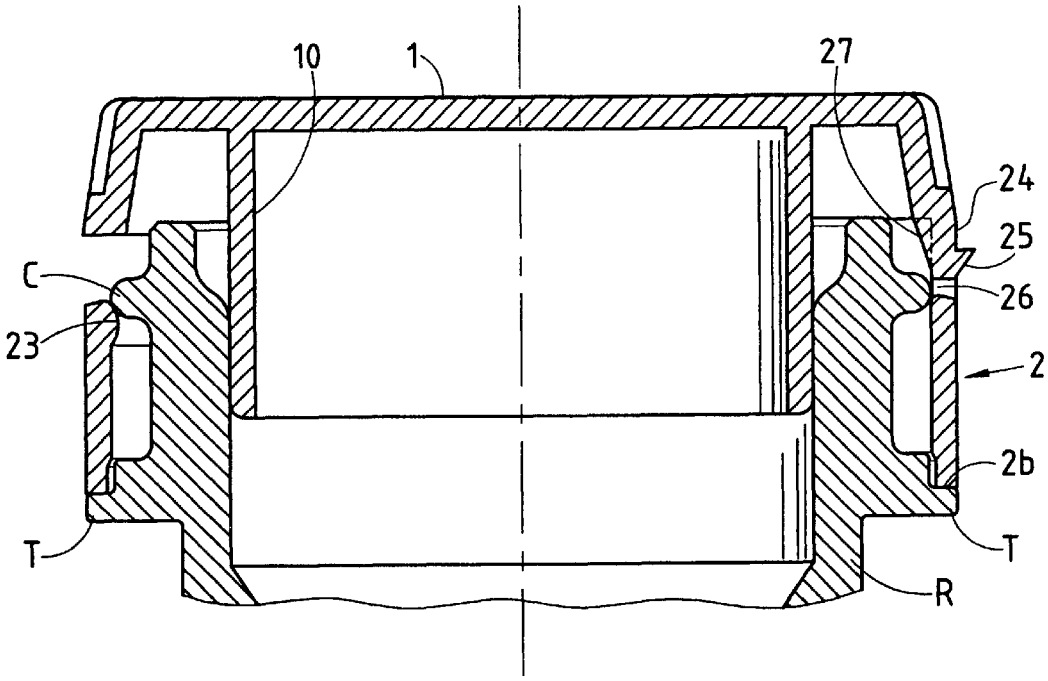
FIG. 3 is a section view on BB of the FIG. 1 cap after assembly on the receptacle.

FIG. 3 shows the same embodiment of the cap after it has snap-fastened in its final assembly position.

In this position, the internal bead 23 is locked under the flange C and the tongue 22 has pivoted outwards and upwards. This pivoting is obtained by the sloping bottom facet 221 and then the central right facet 222 sliding in contact with the flange C.

The shape of the projection 22 is designed as a function of the shape of the flange C so as to obtain the desired amplitude of pivoting.

Snap-fastening thus serves automatically to cause the tongue 22 to project from the plane of the lateral skirt 2 and thus provide means for taking hold of the tamperproofing strip 12. In this position, the bottom edge 2*b* of the lateral skirt 2 is in abutment against a bottom shoulder T formed on the neck of the receptacle R.

The locking tab 24 is substantially perpendicular to the bottom outline of the lid 1 and is provided with a stiffener element 27 that slopes outwards and downwards, pressing against the inside face of said tab 24.

The catch 25 is of trapezoidal cross-section so as to form a hook and it possesses a chamfered outside side face 25*a*.

In the closed position of FIG. 3, the catch 25 is situated below the level of the cavities 210 of the bridges 21*a*, 21*b*.

Figure 4:
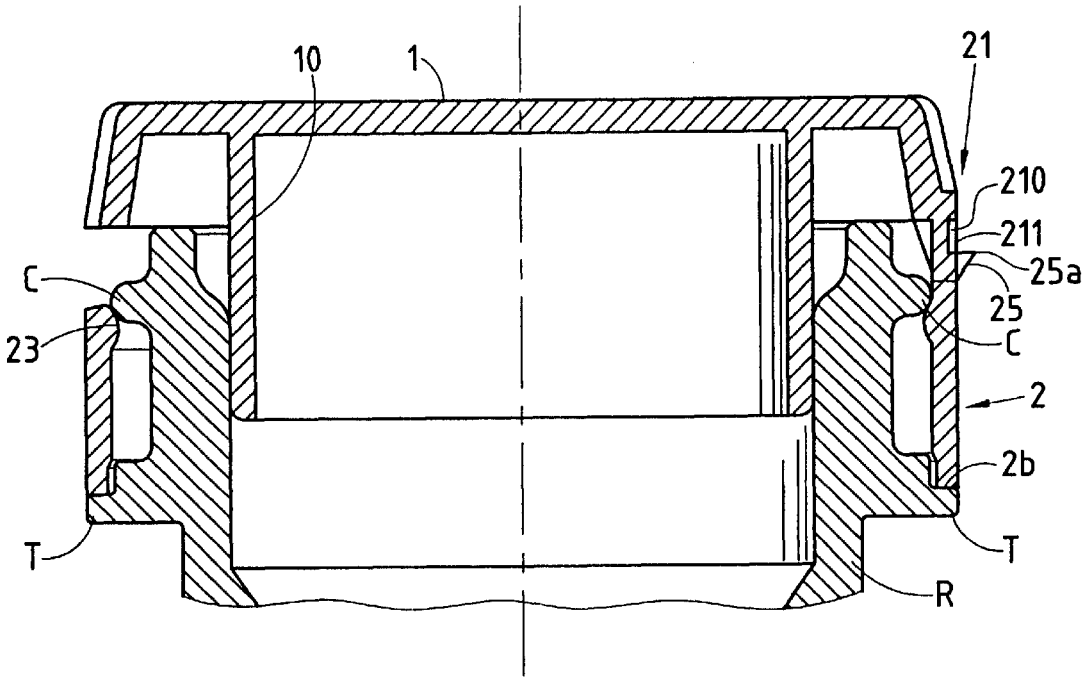
FIG. 4 is a section view on CC of the FIG. 1 cap after the tamperproofing strip has been removed.

FIG. 4 shows the same embodiment of the cap after the tamperproofing strip 12 and its tongue 22 have been removed by tearing and then trimming the film 20.

The cutout 2*a* of the skirt 2 in which the tongue 22 was previously received is now empty and thus defines an opening making it possible to take hold of the lid 1.

Figure 5:
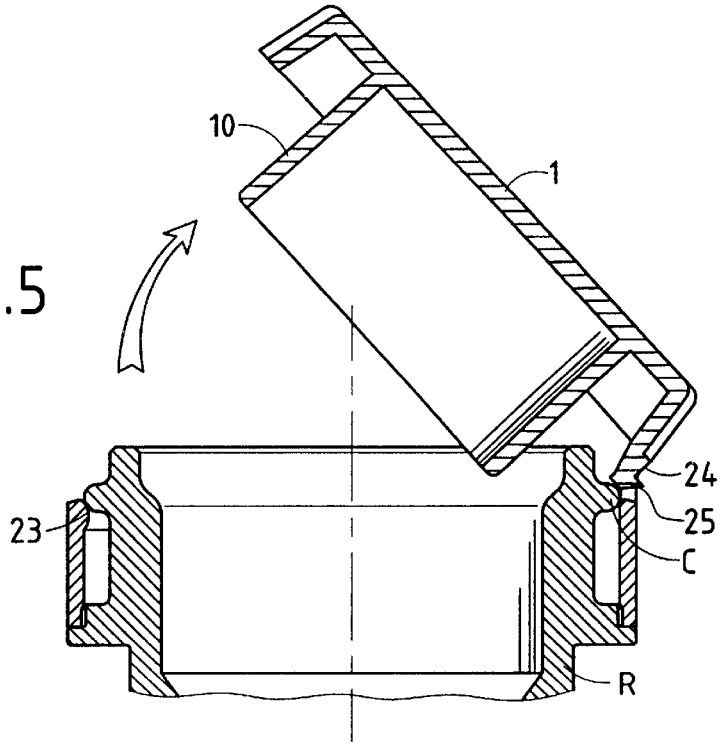
FIG. 5 is a section view on BB of the cap while the lid is being opened.

FIG. 5 shows the same embodiment of the cap while the lid 1 is being opened.

The user raises the lid 1, e.g. by taking hold of its peripheral edge 1*a* via the cutout 2*a*. The elastically deformable nature of the material from which the cap is made allows the lid 1 to be opened by bending and/or deforming the bridges 21*a*, 21*b* forming the hinge 21.

The receptacle R is opened by pivoting the lid 1 upwards about an axis passing through the hinge 21, and taking the sleeve 10 with it.

The sleeve 10 is removed progressively by sliding and, where appropriate, by deforming elastically in contact with the inside wall of the neck of the receptacle.

Simultaneously, the catch 25 of the locking tab 24 comes to bear against the flange C of the receptacle.

The stiffener element 27 acts on the back of the tab 24 to prevent it from bending inwards, but given its slope it allows the tab 24 freedom to bend outwards.

Pivoting the lid 1 upwards therefore causes the tab 24 to bend outwards, thereby having the effect of retracting the catch 25 whose chamfered face 25*a* serves to guide the tab 24 in contact with the flange C.

Bending of the tab 24 may optionally also be accompanied by a small amount of deformation of the side wall of the lid 1.

Figure 6:
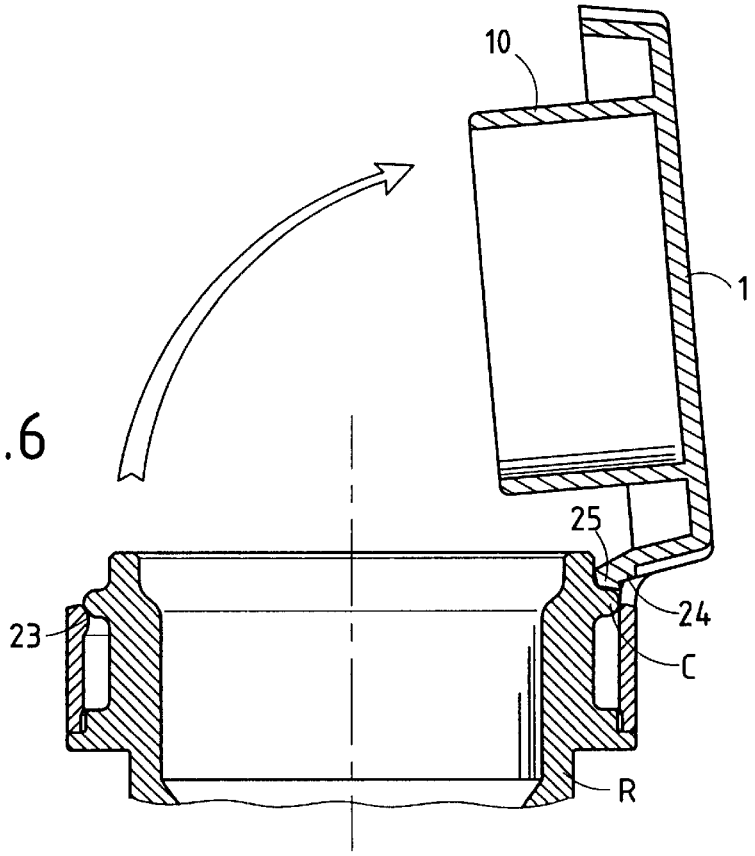
FIG. 6 is a section view of the cap, still on BB, after the lid has been locked in the full-open position.

FIG. 6 shows the cap in the open position with the lid 1 extending at about 90° from its initial, closed position.

In this position, the hook-shaped profile of the catch 25 is locked in the top corner defined by the flange C and the mouth of the receptacle.

This locking is reinforced by the action of the stiffener element 27 and serves to hold the lid 1 stably in the fully-open position, regardless of the orientation of the receptacle R.

The lid 1 is returned to its folded-down closed position by pressing manually on its outside face, thereby forcing its side wall and the catch 25 slightly as they go past the flange C.

What is claimed is:

1. A cap for hermetically closing a receptacle having a retention flange, the cap being constituted by a lid surmounting a lateral skirt which is provided, in a bottom portion, with means for snap-fastenig against said flange, and in a top portion, with a removable tamperproofing strip occupying a action of the periphery of the skirt where it provides a temporary connection with said lid, and also providing a hinge in its complementary fraction;

said lid carrying a locking tab whose free end is provided with a catch suitable for coming into abutment against the flange of the receptacle in the fully-open position while said means for snap-fastening is against said flange.

2. A cap according to claim 1, wherein said hinge comprises two bridges leaving a slot between them into which said locking tab extends.

3. A cap according to claim 2, wherein each of the bridges has a cavity defining a preferred zone for elastic deformation to enable the lid to be pivoted.

4. A cap according to claim 3, wherein said cavity is bordered laterally by two reinforcing ribs.

5. A cap according to claim 3, wherein in the closed position of the lid, said catch is situated below the level of said cavity.

6. A cap according to claim 1, wherein said catch extends radially outwards in the closed position of the lid.

7. A cap according to claim 1, wherein said catch has a chamfered outside side face for guiding the tab in contact with said flange.

8. A cap according to claim 1, wherein said catch has a hook-forming trapezoidal cross-section.

9. A cap according to claim 1, wherein said locking tab is provided with a stiffener element bearing against its inner face to prevent it from bending inwards.

10. A cap according to claim 1, wherein one of the ends of the tamperproofing strip is provided with a tongue.

11. A cap according to claim 10, wherein said tongue is received in a corresponding cutout of the lateral skirt.

12. A cap according to claim 1, wherein said means for snap-fastening the skirt beneath the flange are constituted by a partially peripheral internal bead.

13. A cap according to claim 1, wherein a bottom edge of said skirt comes into abutment against a bottom shoulder on the neck of the receptacle.

14. A cap according to claim 1, wherein it further comprises a cylindrical sleeve secured to the bottom face of said lid and designed to be inserted inside the receptacle to come into leakproof contact with its top inside wall.

15. A cap according to claim 1, wherein said lateral skirt is connected to the lid vertically in register with its peripheral edge in such a manner as to define a cylindrical envelope prior to snap-fastening on the receptacle.

16. A cap according to claim 15, wherein the peripheral edge of the lid is provided with a cutout in its zone diametrically opposite from the hinge.

17. A cap according to claim 1, wherein in the fully-open position of the lid the catch lodges between the receptacle and the flange.

18. A cap according to claim 17, when said hinge is tensioned during movement of said lid to the filly-opened position to force said catch into locked engagement between said receptacle and said flange.

* * * * *